US008020539B2

(12) United States Patent
Maunoury

(10) Patent No.: US 8,020,539 B2
(45) Date of Patent: Sep. 20, 2011

(54) DEVICE FOR DISTRIBUTING INCOMING GASES IN AN INTERNAL COMBUSTION AIR SUPPLY SYSTEM

(75) Inventor: Bertrand Maunoury, Mareil sur Mauldre (FR)

(73) Assignee: Peugeot Citroen Automobiles SA, Velizy Villacoublay (FR)

( * ) Notice: Subject to any disclaimer, the term of this patent is extended or adjusted under 35 U.S.C. 154(b) by 326 days.

(21) Appl. No.: 12/298,021

(22) PCT Filed: Apr. 6, 2007

(86) PCT No.: PCT/FR2007/051081

§ 371 (c)(1),
(2), (4) Date: Oct. 21, 2008

(87) PCT Pub. No.: WO2007/125233

PCT Pub. Date: Nov. 8, 2007

(65) Prior Publication Data

US 2009/0173320 A1 Jul. 9, 2009

(30) Foreign Application Priority Data

Apr. 21, 2006 (FR) ..... 06 51398

(51) Int. Cl.
*F02B 31/08* (2006.01)
*F02B 47/08* (2006.01)
*F02M 27/07* (2006.01)

(52) U.S. Cl. ..... 123/568.18; 123/302; 123/308

(58) Field of Classification Search ..... 123/568.13, 123/568.17, 568.18, 302, 308
See application file for complete search history.

(56) References Cited

U.S. PATENT DOCUMENTS

| | | | | |
|---|---|---|---|---|
| 6,301,888 | B1 | 10/2001 | Gray | |
| 6,431,128 | B1 * | 8/2002 | Dabadie | 123/58.8 |
| 6,478,017 | B2 * | 11/2002 | Bianchi | 123/568.12 |
| 7,556,027 | B2 * | 7/2009 | Duret | 123/568.13 |

FOREIGN PATENT DOCUMENTS

| | | | |
|---|---|---|---|
| EP | 0953744 | A1 | 11/1999 |
| JP | 01244155 | A | 9/1989 |
| JP | 03246361 | A | 11/1991 |

OTHER PUBLICATIONS

International Search Report mailed Sep. 14, 2007 in PCT/FR2007/051081.

* cited by examiner

*Primary Examiner* — Hai Huynh
(74) *Attorney, Agent, or Firm* — Nicolas E. Seckel

(57) ABSTRACT

The invention relates to a device for distributing the incoming gases in an internal combustion air supply system. This system comprises a fresh air intake pipe (1) and an exhaust gas recirculation intake pipe (2) and the internal combustion engine comprises, for each cylinder, a cylinder head that forms a lid over it, at least one inlet gas intake valve (3, 4) and at least one exhaust valve (5) which are mounted in the cylinder head and, in the case of a multi-cylinder engine, a distributor (7) connecting at least the fresh air intake pipe (1) to the cylinders. In this device, the fresh air intake pipe (1) and the exhaust gas recirculation intake pipe (2) are connected to each of the cylinders independently of one another, each of them (1, 2) via an intake valve (3, 4) dedicated to it (1, 2).

10 Claims, 2 Drawing Sheets

Figure 1:
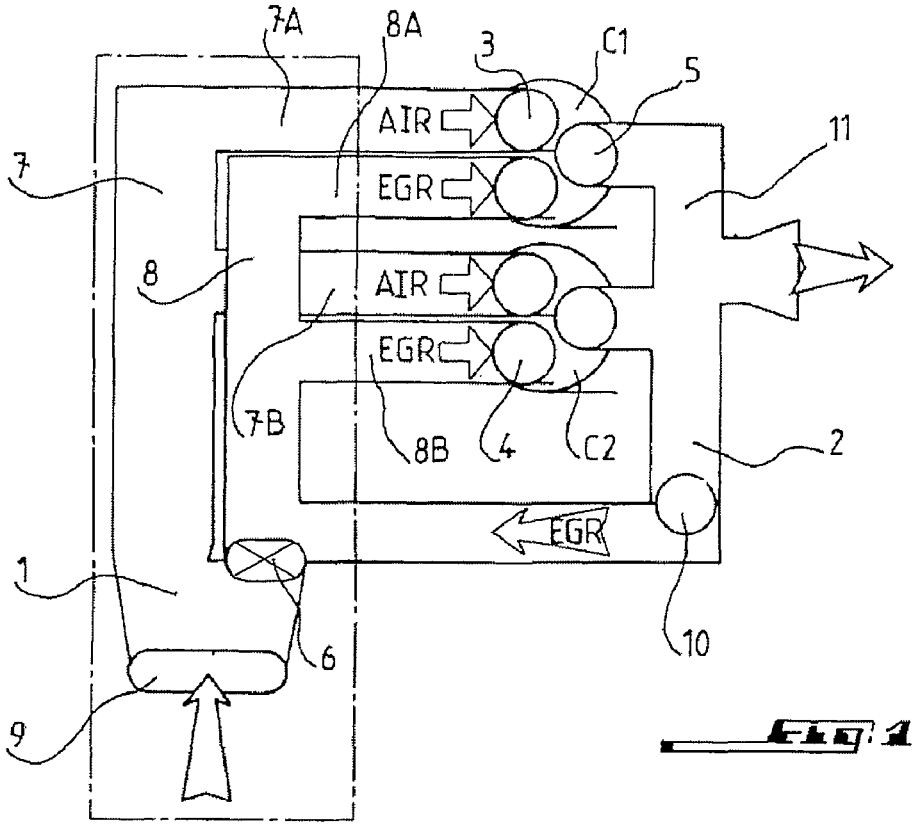

Fig. 3
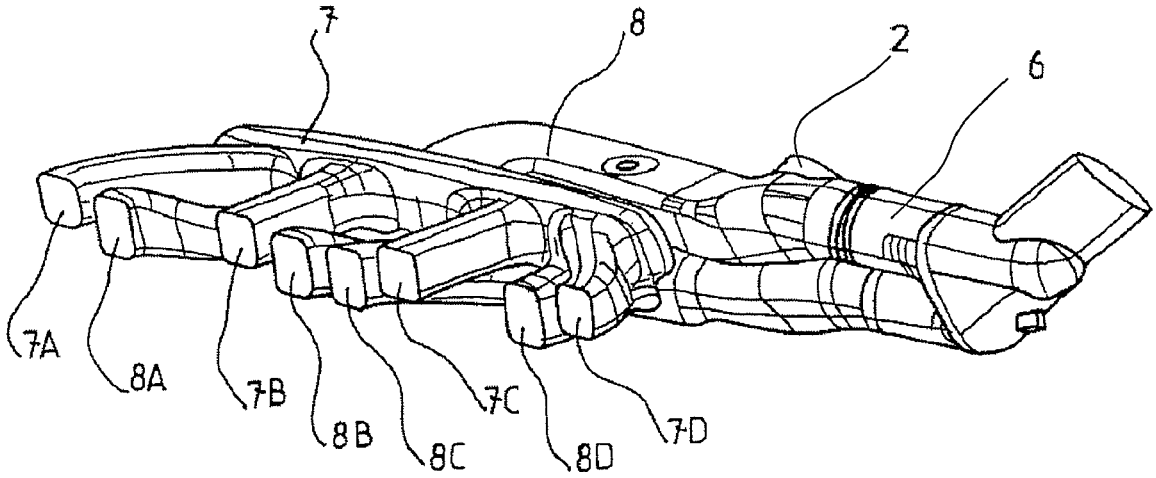
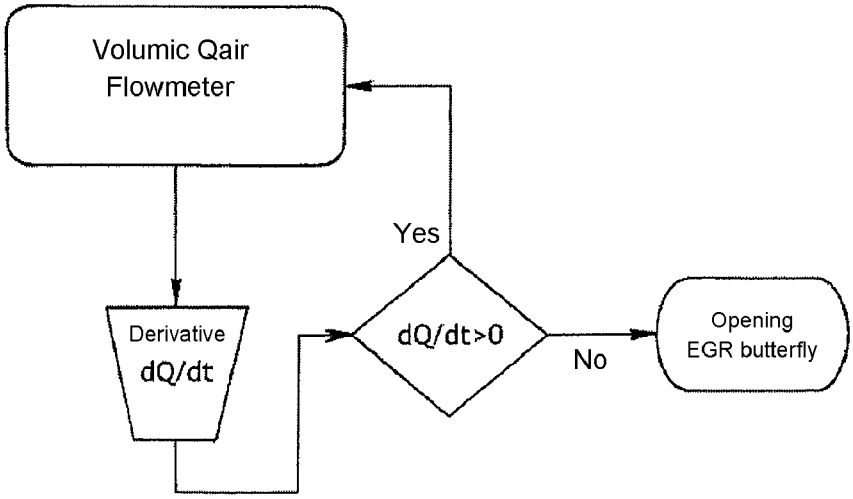
Fig. 4

DEVICE FOR DISTRIBUTING INCOMING GASES IN AN INTERNAL COMBUSTION AIR SUPPLY SYSTEM

The present invention claims priority from French application 0651398, filed Apr. 21, 2006, the contents of which (description, claims, drawings) are incorporated herein by reference.

The present invention relates to a device for distributing gases flowing into an air supply system of an internal combustion engine having one or more cylinders, with exhaust gas recirculation.

The present invention applies equally to compression ignition engines and spark ignition engines.

In the operation of compression ignition engines—also called diesel engines—exhaust gas recirculation makes it possible to reduce emissions of pollutant gases, primarily nitrogen oxides, for which emissions thresholds are regulated.

Exhaust gas recirculation—i.e., reintroducing part of the exhaust gases along with fresh air—can reduce emissions of pollutant gases. The enactment of stricter and stricter emissions standards is bringing the exhaust gas recirculation method into routine use in diesel-type motorisation. It is common to see recirculation rates of around 50%, which means that half of the gases taken in by an internal combustion engine cylinder are recirculated exhaust gases.

An internal combustion engine—or heat engine—having one or more cylinders comprises a cylinder head for each cylinder, forming a cover over it, at least one fresh air intake valve and at least one exhaust valve mounted in the cylinder head. Fresh air is brought to the valves through a volume known as a plenum or distributor. The latter is generally in communication with the exhaust system via a valve or throttle. This is known as an EGR circuit (from the English term "exhaust gas recirculation"). Although EGR is not yet in routine use in spark ignition-type motorization, and the recirculation rates are not generally as high as in diesel motorization, it is being seriously considered for widespread use over the long term, particularly for modes of combustion based on spontaneous rather than spark ignition of the charge. The expected benefits of using EGR are primarily associated with a reduction in fuel consumption enabled by lean mixture combustion.

The exhaust gas recirculation technique is commonly accepted, then, and seems satisfactory overall. However, more in-depth studies of an internal combustion engine operating on an air+recirculated exhaust gas regime show that combustion is very sensitive to heterogeneities in this mixture and to changes in the proportion of EGR in the mass of air flowing into the cylinder.

In order to increase the homogeneity of air+exhaust gas mixtures, more and more complex systems are being developed. In some systems, such as the one used for the diesel engine described in document U.S. Pat. No. 6,301,888, the recirculated gas is admitted into the fresh air very near the engine intake valves in order to improve system responsiveness.

However, air supply systems with exhaust gas recirculation have some disadvantages due to the conditions needed for feeding recirculated exhaust gas to the engine.

If air with a pressure P is admitted into the engine, and exhaust gas is discharged at a pressure P', the flow of recirculated exhaust gas toward the intake will be initiated only if P' is greater than P. Of course, one can tinker with the exhaust acoustics, but this does not make it possible to establish a recirculated exhaust gas stream with a high flow rate. At this point, increasing the level of recirculated exhaust gas is possible only by increasing the pressure differential (P'−P).

The difference (P'−P) affects fuel consumption as a factor in calculating the work of the low-pressure loop of the engine cycle, and therefore as a factor in engine output.

The purpose of the invention is to propose simpler means than those used up until now for supplying air to an internal combustion engine with exhaust gas recirculation.

The purpose of the invention is achieved with a distribution device for gas flowing into an air supply system of an internal combustion engine having one or more cylinders, the system comprising an intake conduit for fresh air and an intake conduit for recirculated exhaust gas, and the internal combustion engine comprising a cylinder head for each cylinder, forming a cover over it, at least one intake valve for inflowing gas and at least one exhaust valve, which are mounted in the cylinder head, and in the case of a multi-cylinder engine, a manifold connecting at least the fresh air intake conduit to the cylinders. According to the invention, the fresh air intake conduit and the recirculated exhaust gas intake conduit are connected to the single cylinder or to each of the cylinders independently of one another, each through its own designated intake valve.

More particularly, the invention allows an increase in the rate of exhaust gas recirculation, and thus a decrease in pollutant emissions. Such an increase can be achieved without resulting in a gross overconsumption of fuel, linked to the difference (P'−P), which is generally necessary to bring in this flow. Likewise, the invention makes it possible to improve the operation and performance of an internal combustion engine with compression or spark ignition when it admits a mixture of air+recirculated exhaust gas. Lastly, the invention makes it possible to improve the transitional behavior of the engine when changing over from an operating point with recirculated exhaust gas to an operating point without recirculated exhaust gas, and more generally, when wide variations occur in the pressure differential (P'−P).

The device of the invention is designed to operate based essentially on the principle that the fresh air flow is established solely via the pressure P, and the recirculated exhaust gas flow is established solely via the pressure P'.

This arrangement makes it possible to operate with recirculated exhaust gas when pressures P and P' are equal, which is advantageous from a fuel consumption standpoint, as this minimizes the work of the low-pressure loop of the engine cycle. In addition, this arrangement makes it possible to increase the rate of recirculated exhaust gas in the cylinder, since the flow of recirculated exhaust gas is no longer initiated by the pressure differential (P−P'), but only by the pressure P'.

The device of the invention additionally makes the proportioning of inflowing gases more homogeneous, cylinder by cylinder, without resorting to complex tools to homogenize the two gas streams: the fresh air and the recirculated exhaust gas, respectively.

Moreover, the device of the invention ensures that each of the cylinders of the internal combustion engine has a dedicated supply of recirculated exhaust gas. The gas exhaust valves lead directly to the recirculated gas intake valves, disregarding the optional manifold.

This is why, in a multi-cylinder engine, the present invention proposes using an intake manifold for each stream. At the same time, for the transitional aspects, this design of the invention allows the use of a control strategy for a butterfly valve placed at the recirculated exhaust gas distributor inlet.

One of the two distributors is in communication with the exhaust system via a traditional EGR circuit: a valve or throttle with or without a water-gas exchanger.

The flow of recirculated exhaust gas into the cylinders is directly subject to the following conditions: (P'−Pcyl)−dP where P' is the average pressure in the exhaust collector, Pcyl is the pressure in the cylinder, and dP is the loss of charge in the EGR circuit, which is adjustable through the aforementioned valve or throttle.

With this device, the inflow of recirculated exhaust gas is thus not dependent on the pressure differential established at the ends of the cylinders (P'−P), but on (P'−Pcyl).

By means of a butterfly valve, which is meant to remain closed over the majority of the EGR operating range, this manifold can also be in communication with fresh air. In this way, when it is not desirable to operate with recirculated exhaust gas, this manifold can be used to bring air to the intake valves that are assigned to it.

In an alternative embodiment of the invention, when changing engine modes, the butterfly valve can be directed from air+recirculated exhaust gas to air only.

For its part, the other distributor is connected to the fresh air intake line. It is possible to attach a butterfly valve, preferably placed upstream of the two manifolds. Then it will serve as an engine muffler during stop phases, or a fresh air flow pressure P regulator.

With this split manifold device, the inflow of air is therefore not disrupted by the recirculated exhaust gas flow, and it occurs in the conditions (P−Pcyl).

With this two-part distributor device, the recirculated exhaust gas comes directly to the valves via their dedicated manifolds, ensuring good air and recirculated exhaust gas distribution cylinder by cylinder, without resorting to a complex homogenization device. The two functions of mixing and homogenizing the air and recirculated exhaust gas streams are assumed by the cylinder itself.

The dedicated recirculated exhaust gas manifold will have enough volume to supply the engine's demand for recirculated exhaust gas flow over its entire operating range, typically a volume of the type aC/N, where C is the total engine displacement, N is the number of cylinders, and a is set between 0.3 and 3, preferably around 1.5. The volume-related sensitivity remaining within the primary conduits, between the valves and the manifold.

The second manifold will have substantially the same volume, and will be dedicated to supplying the cylinder(s) with fresh air.

As stipulated above, an alternative embodiment of the invention will have a butterfly valve upstream of the recirculated exhaust gas manifold (reference 6 in the drawings) that can be slightly open during operation. This is particularly for cases where the need for air in the cylinders is such that the stream cannot make it through using only the dedicated air manifold, typically in cases of full engine loads or very high partial loads, or high engine speeds.

In another variant of the invention, the butterfly valve can be controlled when changing engine intake modes (from air+recirculated exhaust gas to air only) in order to gain power, wherein the higher the rate of recirculated gas, the higher the gain.

When changing from air+recirculated exhaust gas to air only, the butterfly valve will remain closed as long as the air distributor is near its operational limits, i.e., up to its volumetric flow rate saturation. After that, the manifold initially dedicated to recirculated exhaust gas can be opened to fresh air. This makes it possible to gain responsiveness in the air loop by minimizing the effect of emptying the dedicated manifold of recirculated exhaust gas.

Due to the dynamics of the recirculated exhaust gas butterfly valve, it will be necessary to make provision for saturation. In this case, the test dQ/dt>0 will be replaced by dQ/dt>n, with n being a setpoint value calibrated to represent the need for acceptance.

Lastly, the system thus described can be advantageously associated with a variable, valve-by-valve timing system that enables optimal control of the air and recirculated exhaust gas flows, and thus, the rate of recirculated exhaust gas in the cylinder.

Figure 2:
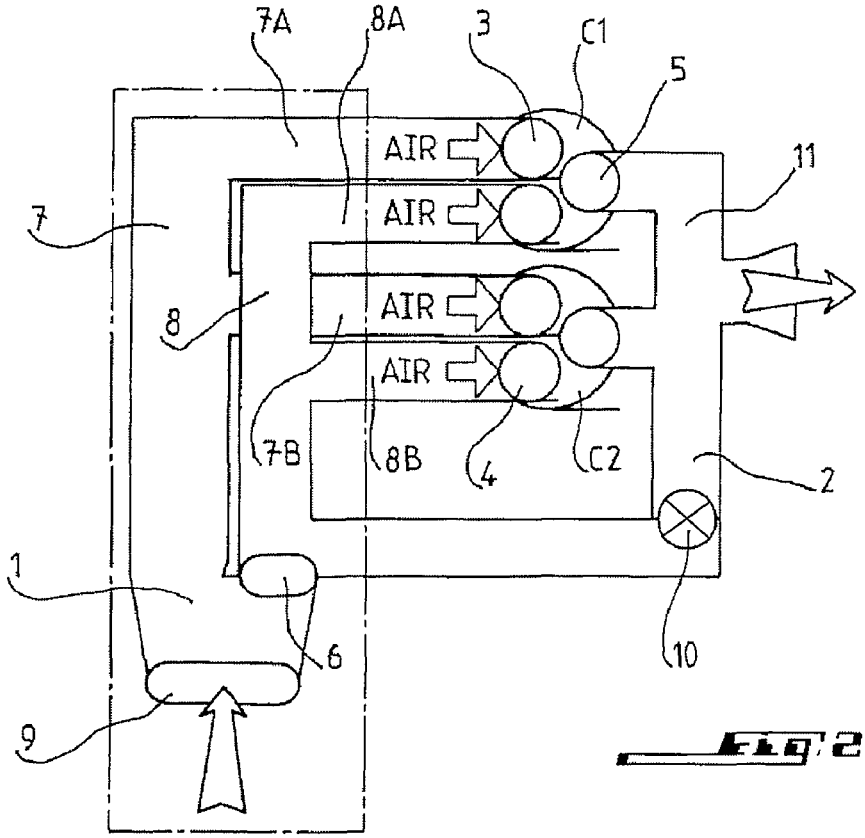

In the annexed drawings, the main characteristics of the present invention will be shown as follows:

FIG. 1 schematically shows a device according to the invention in a position where it is operating with recirculated exhaust gas, FIG. 2 shows the device of FIG. 1 operating on fresh air only, FIG. 3 is an example of an embodiment of a device according to the invention, and FIG. 4 shows a control logic diagram for an EGR butterfly valve.

The inflowing gas distribution device according to the invention is shown in FIGS. 1 and 2 for an engine with two cylinders C1 and C2. The system comprises a fresh air intake conduit 1, an recirculated exhaust gas intake conduit 2, and an exhaust gas collector 11, from which the recirculated exhaust gas intake conduit branches. The engine additionally comprises a cylinder head for each cylinder, forming a cover over it, and two intake valves 3, 4 for inflowing gases and an exhaust valve 5, which are mounted in the cylinder head. The fresh air intake conduit 1 is connected to the cylinders C1, C2 by means of a manifold 7, and the recirculated exhaust gas intake conduit 2 is similarly connected to the cylinders C1, C2 by means of a manifold 8.

According to the invention, the fresh air intake conduit 1 is connected to the cylinders C1, C2 by dedicated intake valves 3, as well as by the manifold 7 with its two branches 7A, 7B. The recirculated exhaust gas intake conduit 2 is similarly connected to the cylinders C1, C2 by dedicated valves 4, as well as by the manifold 8 with its two branches 8A, 8B. In this way, each of the two branches of the two manifolds 7 and 8 is connected to the corresponding cylinder C1 or C2, by the first intake valves 3 or by the second intake valves 4, respectively.

Advantageously, as shown in FIGS. 1 and 2, the recirculated exhaust gas intake conduit 2 has a first butterfly valve 6 for controlling a passage between the fresh air intake conduit 1 and the recirculated exhaust gas conduit 2. The first butterfly valve 6 is for example controlled by the onboard computer or the part thereof designed to operate the various control functions necessary for smooth engine operation.

As is clearly shown in FIGS. 1 and 2, the system according to the invention can be equipped with a second butterfly valve 9 positioned in the fresh air intake conduit 1 upstream of the first butterfly valve 6 of the intake conduit of the recirculated exhaust gas conduit 2. The second butterfly valve 9 is meant to be activated during the engine stop phases, for example.

The flow of the part of the exhaust gas that is recirculated is affected by an EGR valve 10.

When the engine is operating normally with exhaust gas recirculation, the EGR valve 10 is open based on the percentage of exhaust gas in the exhaust gas/fresh air mixture to be attained in the cylinders.

When the engine has to be supplied with fresh air only, the EGR valve 10 is closed, and the first butterfly valve 6 is completely open so that after going through the second butterfly valve 9, the fresh air can be distributed between the fresh air intake manifold 7 and the recirculated exhaust gas intake manifold 8.

FIG. 3 very schematically shows an intake assembly for a four-cylinder engine. More particularly, one can see the fresh air intake manifold 7 and the recirculated exhaust gas intake manifold 8 with branches respectively referenced 7A, 7B, 7C, 7D for the fresh air manifold, and branches referenced 8A, 8B, 8C, 8D for the recirculated exhaust gas intake manifold 8.

FIG. 4 shows a control logic diagram for an EGR butterfly valve for transitional operation going from the air+recirculated exhaust gas zone to the air-only zone. This diagram includes the test dQ/dt>0, which can be replaced as explained above by the test dQ/dt>n, where n is a setpoint value calibrated to represent the need for acceptance.

The invention claimed is:

1. Distribution device for gases flowing into an air supply system of an internal combustion engine, wherein the internal combustion engine comprises:

a cylinder head for each cylinder, forming a cover over it, at least first and second intake valve for inflowing gases, a least one exhaust valve for exhaust gases, which are mounted in the cylinder head, wherein the exhaust valves are connected via exhaust valve passages to an exhaust line connected to the outside along a flow path of exhaust gases exhausted to the outside, an exhaust collector placed downstream of the exhaust valve passages and upstream of the exhaust line along the path of the exhaust gases exhausted to the outside, wherein the exhaust collector intersects the exhaust valve passages along the path of the exhaust gases exhausted to the outside, wherein the air supply system comprises:

a recirculated exhaust gas intake conduit that branches from the exhaust collector, a fresh air intake conduit connected to fresh air, wherein the distribution device comprises:

a first manifold connecting the fresh air intake conduit to the cylinders by the first intake valves, and a second manifold connecting the recirculated exhaust gas intake conduit to the cylinders by the second intake valves, so that the fresh air intake conduit and the recirculated exhaust gas intake conduit are connected to the single cylinder or to each of the cylinders independently of one another, each through its own designated intake valve.

2. Device according to claim 1, wherein the recirculated exhaust gas intake conduit has a first butterfly valve for controlling a passage between the fresh air intake conduit and the recirculated exhaust gas intake conduit.

3. Device according to claim 2, wherein the fresh air intake conduit has a second butterfly valve positioned downstream of the exhaust collector and upstream of the first butterfly valve of the recirculated exhaust gas intake conduit.

4. Device according to claim 3, wherein the passage between the fresh air intake conduit upstream of the first manifold and the recirculated exhaust gas intake conduit is located upstream of the second manifold.

5. Device according to claim 2, which comprises control means making it possible to control the first butterfly valve so as to open this valve completely when changing engine operating modes from mixed fresh air plus recirculated exhaust gas to fresh air only.

6. Device according to claim 2, which comprises control means making it possible to control the first butterfly valve so as to open this valve somewhat when the engine is operated at full load, at high partial loads, or at high engine speeds.

7. Device according to claim 2, wherein the passage between the fresh air intake conduit upstream of the first manifold and the recirculated exhaust gas intake conduit is located upstream of the second manifold.

8. Device according to claim 1, wherein the two manifolds have at least approximately the same volume.

9. Device according to claim 1, which comprises a variable, valve-by-valve timing system that enables cylinder-by-cylinder control of the respective fresh air and recirculated exhaust gas flows.

10. Motor vehicle characterized in that it includes a device according to claim 1.

* * * * *